United States Patent [19]

Lane

[11] Patent Number: 4,705,213

[45] Date of Patent: Nov. 10, 1987

[54] HEAT UNIT RECYCLER

[76] Inventor: Elvin Lane, 119 N. Superior, P.O. Box 1624, Hutchinson, Kans. 67501

[21] Appl. No.: 823,032

[22] Filed: Jan. 27, 1986

[51] Int. Cl.[4] ..... F24H 3/06

[52] U.S. Cl. ..... 237/7; 219/341; 237/16

[58] Field of Search ..... 237/16, 7, 8 R, 70; 219/324, 323, 341

[56] References Cited

U.S. PATENT DOCUMENTS

| | | | |
|---|---|---|---|
| 1,581,386 | 4/1926 | Clark | 237/16 X |
| 1,666,816 | 4/1928 | Falk | 237/7 X |
| 3,139,516 | 6/1964 | Boecher | 237/16 X |
| 4,424,934 | 1/1984 | Wilhoite | 237/16 X |

*Primary Examiner*—Henry A. Bennet
*Attorney, Agent, or Firm*—Larson and Taylor

[57] ABSTRACT

A heat unit recycler for the exchange of air in a room includes an enclosed tank containing a liquid to be heated. A heating mechanism is provided for heating the liquid in the tank and a temperature control is provided for controlling the heating device to maintain the liquid in the tank at a predetermined value. A plurality of heat exchange tubes pass through the tank. A fan at the outlet end of the heat exchange tubes draws room air into the tubes and blows heated room air from the tubes back into the room. A speed control is provided for the fan in order to control the rate of flow of the air moved by the fan. Preferably, a small air space is provided at the top of the tank and a radiator-type pressure cap is also provided at the top of the tank for relieving excess pressure in the tank by movement of air out of and into the air space. Where the liquid in the tank has an odor, a filter is also provided for filtering any odor from the air passing outward from the airspace in the tank through the pressure cap. In order to save space, the fan is located on one side of the tank and the heat exchange tubes are substantially J-shaped so as to extend from one longitudinal end of the tank and out the side adjacent the other longitudinal end of the tank. Conveniently, the various elements of the heat unit recycler are mounted on a base and a cover is provided with suitable vents therein.

9 Claims, 3 Drawing Figures

HEAT UNIT RECYCLER

FIELD OF THE INVENTION

The present invention relates to a heat unit recycler, and more particularly to a portable and efficient system for the warming of air in a room.

BACKGROUND OF THE INVENTION

Area space heaters have been disclosed in the prior art for heating room air. For example, in U.S. Pat. No. 1,666,816 (Falk), an electrically heated water-conditioning radiator is provided in which the water is heated and circulated. A fan is provided adjacent the radiator for directing room air throughout the radiator. In U.S. Pat. No. 3,567,905 (Ferraro), a space heater including an upper heat exchanger section and a lower blower section is disclosed. A convector structure is mounted within the heat exchanger section and arranged for the output of a blower to flow therearound.

Additional space heaters using either electric heating or warming of a fluid are disclosed in the following U.S. Pat. Nos.: 3,927,299 (Sturgis); 3,139,916 (Boecher); 3,408,479 (Welch); 2,080,949 (McCombs et al); 4,053,732 (Carter); 3,681,567 (Boecher); 3,563,225 (Masrich); and 2,276,093 (Robbins).

SUMMARY OF THE INVENTION

In accordance with the present invention, a heat unit recycler for heating the air in a room is provided. The heat unit recycler includes an enclosed tank which contains a liquid to be heated. The tank is enclosed so that the liquid remains in the tank at all times. A heating means is then provided for heating the liquid in the tank. A temperature control means controls the heating means to maintain the temperature of the liquid in the tank at an approximate temperature or between a predetermined range. A plurality of heat exchange tubes pass through the tank. These tubes are fluidly isolated from the liquid in the tank and each tube has an inlet for room air and an outlet for heated air. A fan means is then provided for drawing heated room air from the outlets of the tubes and for blowing this heated air into the room. A speed control means is further provided for controlling the rate of flow of air moved by the fan means. A switch means is also provided for turning the heating means and fan means on and off as desired. The tank, heating means, fan means, speed control means, and switch means are located on a base.

In the preferred embodiment of the present invention, a small air space provided at the top of the top of the tank. A radiatortype pressure cap is then provided in the top of the tank for relieving excess pressure in the tank. When the liquid has an odor, such as where the liquid is a mixture of water and antifreeze, a suitable filter means is provided for filtering any odor from the air passing outward from the air space in the tank through the pressure cap. Preferably, such a filter means includes a carbon filter.

In the preferred embodiment, the tank has opposed longitudinal ends with the fan means located on one side of the tank adjacent one longitudinal end thereof. The heat exchange tubes are then substantially J-shaped. With this configuration, the tubes extend from a respective inlet at the other longitudinal end of the tank to a respective outlet through the one side of the tank and adjacent the fan means. Conveniently, a cover is also provided which is mounted on the base and which covers the tank, heating means, and fan means. A plurality of vents are then provided in this cover in order to provide a fluid connection for the inlets of the tubes with the room air. A screened outlet in the cover is also provided for the hot air pumped out by the fan means.

It is an advantage of the present invention that an especially efficient and compact heat unit recycler is provided.

It is also an advantage of the present invention that a simple and relatively easily moved heat unit recycler is provided.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
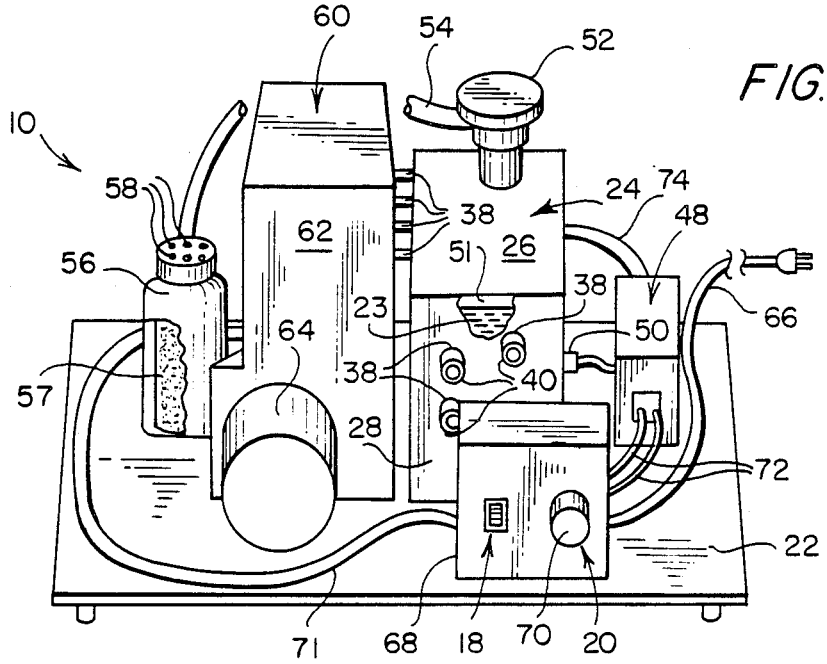
FIG. 1 is a front perspective view of the heat unit recycler of the present invention with the cover removed.
Figure 2:
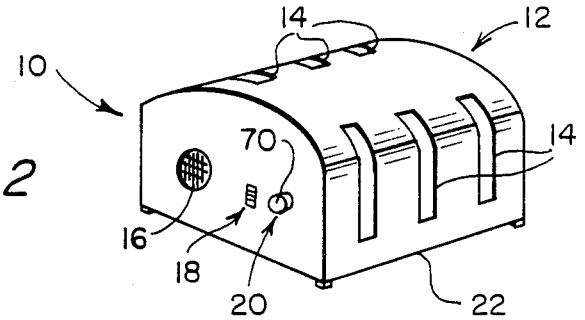
FIG. 2 is a front perspective view of the heat unit recycler depicted in FIG. 1 with the cover in place.

With reference now to the drawings in which like numerals represent like elements throughout the several views, a heat unit recycler tank is depicted in FIGS. 1 and 2. As shown in FIG. 2, heat unit recycler 10 normally includes a cover 12 which presents a pleasant appearance for heat unit recycler 10. Cover 12 includes inlet air vents 14 around the sides thereof and a screened hot air outlet 16 at the front thereof. Also located at the front of cover 12 is a switch means 18 for turning heat unit recycler 10 on and off and a variable speed control means 20 which controls the volume of air pumped out by the fan means 60.

As shown in greater detail in FIG. 1 (where cover 12 is omitted for clarity), heat unit recycler 10 also includes a base 22. Mounted on base 22 is an enclosed tank 24 enclosing a suitable liquid 23 to be heated. Preferably, liquid 23 to be heated is a water and antifreeze mixture having a suitable high boiling point.

Figure 3:
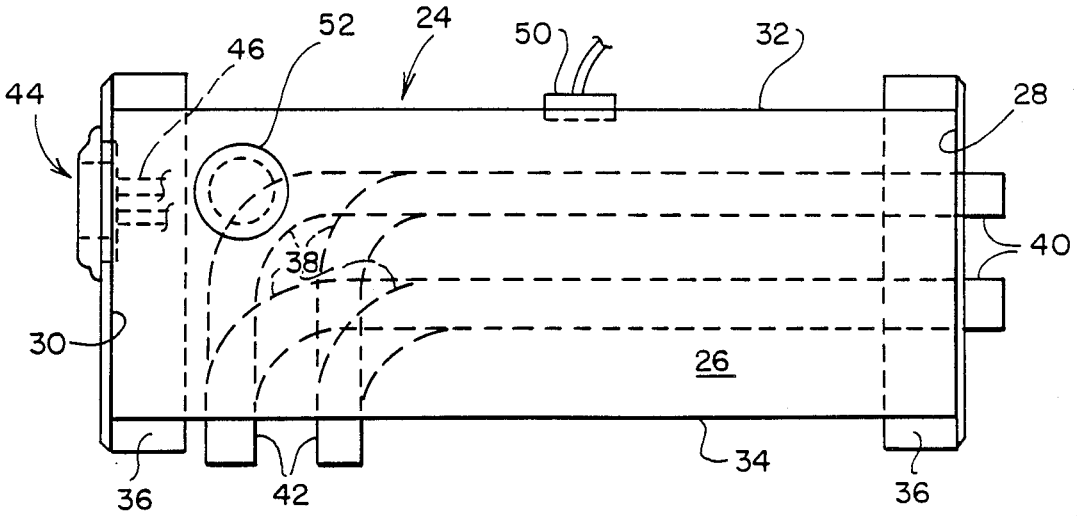
FIG. 3 is a top plan view of the liquid tank depicted in FIG. 1.

Tank 24 is shown in greater detail in FIG. 3. Tank 24 is elongate and includes a top 26, a front end 28, a back end 30, a right side 32, and a left side 34. For convenience in mounting, tank 24 is also preferably provided with mounting brackets 36 (which had been omitted from FIG. 1 for clarity).

Mounted within tank 24 are four J-shaped heat exchange tubes 38. As shown, each heat exchange tube 38 includes an inlet end 40 which extends through front end 28 of tank 24. Each heat exchange tube 38 also includes an outlet end 42 which extends through left side 34 of tank 24 adjacent back end 30. Preferably, the tank 24 and heat exchange tube 38 are steel and exchange tube 38 are mounted in tank 24 by welding.

In order to heat liquid 23 within tank 24, a heating means 44 is provided. Heating means 44 is conveniently an electric resistive element typically used for electric heating in hot water tanks. Such a heating means 44 includes a heating element 46 (shown partially in phantom) which is U-shaped and which extends into tank 24 as shown.

In order to control the temperature of liquid 23 in tank 24, a temperature control means 48 is provided. Temperature control means 48 includes a sensor 50 for sensing the temperature of liquid 23 in tank 24. Temperature control means 48 is designed to maintain the temperature of liquid 23 in tank 24 at a predetermined approximate value, such as 240 degrees Fahrenheit. Depending upon the temperature sensed by sensor 50, heating means 44 is either energized or deenergized as appropriate.

As liquid 23 within tank 24 expands as it is heated, a small air space 51 is preferably provided at the top of the liquid in tank 24. Also provided in the top of tank 24 is a radiator-type pressure cap 52 as shown. Pressure cap 52 is designed to allow air from air space 51 in tank 24 to be pushed out of tank 24 when liquid 23 in tank 24 expands sufficiently and the pressure of the air reaches a predetermined value. Similarly, after use of heat unit recycler 10 when liquid 23 in tank 24 cools down to room temperature and a vacuum pressure is created in tank 24, pressure cap 52 allows air to be drawn back into tank 24 to relieve the vacuum pressure created.

In the preferred embodiment of the present invention, the passage (not shown) in pressure cap 52 through which air passes into and out of tank 24 is connected to one end of a hose 54. The other end of hose 54 is connected to a filter means 56. Filter means 56 preferably includes a bottom opening (not shown) to which hose 54 is attached, a carbon filter 57 therein, and vent holes 58 in the top thereof. Thus, as air is pushed out of tank 24, which air may have an objectionable odor due to the presence of the antifreeze in liquid 23 contained in tank 24, this objectionable odor is filtered by filter means 56 as the air passes from hose 54 to vent holes 58. Obviously, reverse air flow is also possible when tank 24 cools off. It should be appreciated that the location of the connection to hose 54 at the bottom of filter means 56 helps prevent the inadvertent overflow of any vapor from filter means 56 even if this vapor inadvertently enters hose 54.

As shown in FIG. 1, located adjacent tank 24 is a fan means 60. Fan means 60 includes a housing 62 having an outlet 64. It should be appreciated that outlet 64 aligns with screened outlet 16 when cover 12 is in place on base 22. Outlet ends 42 of heat exchange tubes 38 extend through the side of housing 62 to from an inlet for fan means 60.

Heat unit recycler 10 is connected to a suitable source of AC electric current by a cord 66. Cord 66 is connected to switch means 18 located in an electrical box 68. Cord 66 also supplies power to speed control means 20 which is suitably a rheostat switch having a knob 70 located on the outside of cover 12. Depending on the setting of knob 70, suitable electrical power is supplied to fan means 60 via cord 71 so that the desired volume of air is pumped by fan means 60. Switch means 18 supplies power to temperature control means 48 and heating means 44 by wires 72 and 74.

In operation, heat unit recycler 10 functions in the following manner. Initially, with cord 66 connected to a suitable source of AC power, heat unit recycler 10 is placed at a convenient location in a room. Next, switch means 18 is moved to the on position and heat unit recycler power is supplied to temperature control means 48. If liquid 23 in tank 24 is below the predetermined temperature value (which is should be at startup), temperature control means 44 then supplies electrical power by wire 74 to heating means 44. This causes liquid 23 in tank 24 to be quickly heated by heating element 46. At the same time, depending on the setting of knob 70 of speed control means 20, fan means 60 is activated via cord 71. This causes room air to be drawn into inlet ends 40 of heat exchange tubes 38. As the room air passes through heat exchange tubes 38, the room air is heated by heat exchange with heated liquid 23 contained in tank 24. Typically, when liquid 23 in tank 24 is heated to approximately 240 degrees Fahrenheit, the temperature of the room air exiting from outlet end 42 of heat exchange tube 38 is approximately 135 degrees Fahrenheit. This heated air is driven by fan means 60 out of fan outlet 64 and screened outlet 16 into the room.

Depending upon the needs of the room to be heated, speed control means 20 for fan means 60 is appropriately adjusted by rotation of knob 70 to control the volume of air moved by fan means 60 and hence the heat output of heat unit recycler 10. If desired, as heat unit recycler 10 is especially efficient, heat unit recycler 10 can be left running in a room of a house to heat that room and some of the remainder of the house heated to a comfortable temperature and helps to keep the primary heating source off for longer periods of time.

While the present invention has been described with respect to a heating means including an electrical heating element 36, it should be appreciated that other heating means are also possible. For example, a flammable fluid could also be used with an appropriate burner for heating liquid 23 in tank 24. It should also be appreciated that liquid 23 in tank 24 is directly heated by heating means 60 without the necessity for any wasteful circulation of the liquid.

While the present invention has been described with respect to an exemplary embodiment thereof, it will be understood by those of ordinary skill in the art that variations and modifications can be effected within the scope and spirit of the invention.

I claim:

1. A heat unit recycler for air in a room comprising:

an enclosed tank containing a liquid to be heated which liquid has an odor, said tank having a small air space and being enclosed such that the liquid remains in said tank at all times, said tank including a radiator-type pressure cap at a top of said tank for relieving excess pressure in said tank by the movement of air out of and into the air space in said tank;

a filter means for filtering any odor from the air passing outward from the air space in said tank through said pressure cap;

a heating means for heating all of the liquid in said tank;

a temperature control means for controlling said heating means to maintain the liquid in said tank at a predetermined value;

a plurality of heat exchange tubes passing through the liquid in said tank, the interiors of said tubes being fluidly isolated from the liquid and each said tube having an inlet for room air and an outlet for heated air;

a fan means for drawing heated room air from said outlets of said tubes and for blowing the heated room air into the room;

a speed control means for turning on and off and controlling the rate of flow of air moved by said fan means;

a switch means for turning said heating means on and off; and a base on which said tank, said heating means, said fan means, said speed control means, and said switch means are located.

2. A heat unit recycler for air in a room comprising:

an enclosed tank containing a liquid to be heated, said tank including opposed longitudinal sides and opposed longitudinal ends and being enclosed such that the liquid remains in said tank at all times;

a heating means for heating all of the liquid in said tank;

a temperature control means for controlling said heating means to maintain the liquid in said tank at a predetermined value;

a plurality of heat exchange tubes passing through the liquid in said tank, the interiors of said tubes being fluidly isolated from the liquid and each said tube having an inlet for room air and an outlet for heated air;

a fan means for drawing heated room air from said outlets of said tubes and for blowing the heated room air into the room, said fan means being located on one longitudinal side of said tank adjacent one longitudinal end thereof;

a speed control means for turning on and of and controlling the rate of flow of air moved by said fan means;

a switch means for turning said heating means on and off; and a base on which said tank, said heating means, said fan means, said speed control means, and said switch means are located; and wherein said heat exchange tubes are essentially J-shaped so as to extend from a respective said inlet of said tubes located at the other longitudinal end to a respective outlet of said tubes located through the one longitudinal side and adjacent said fan means.

3. A heat unit recycler as claimed in claim 2 wherein there is a small air space in said tank; and wherein said tank includes a radiator-type pressure cap at a top of said tank for relieving excess pressure in said tank by the movement of air out of and into the air space in said tank.

4. A heat unit recycler as claimed in claim 2 wherein the liquid in said tank has an odor; and further including a filter means for filtering any odor from the air passing outward from the air space in said tank through said pressure cap.

5. A heat unit recycler as claimed in claim 1 wherein said filter means includes a carbon filter and the liquid is a mixture of water and antifreeze.

6. A heat recycler as claimed in claim 1 wherein said tank has opposed longitudinal sides and opposed longitudinal ends; wherein said fan means is located on one said longitudinal side of said tank adjacent one said longitudinal end thereof; and wherein said heat exchange tubes are substantially J-shaped, so as to extend from a respective said inlet of said tubes located at the other said longitudinal side and adjacent said fan means.

7. A heat unit recycler as claimed in claim 6 and further including a cover which is mounted on said base and which covers said tank, said heating means and said fan means; and wherein a plurality of vents are provided in said cover for fluidly connecting the inlets of said tubes with the room air, and a screened outlet is provided for said fan means.

8. A heat unit recycler as claimed in claim 2 wherein said filter means includes a carbon filter and the liquid is a mixture of water and antifreeze.

9. A heat unit recycler as claimed in claim 2 and further including a cover which is mounted on said base and which covers said tank, said heating means and said fan means; and wherein a plurality of vents are provided in said cover for fluidly connecting the inlets of said tubes with the room air, and a screened outlet is provided for said fan means.

* * * * *